US005435248A

United States Patent [19]

Rode et al.

[11] Patent Number: 5,435,248

[45] Date of Patent: * Jul. 25, 1995

[54] EXTENDED RANGE DIGITAL DELAY DETONATOR

[75] Inventors: Kenneth A. Rode, Burlington; Robert G. Pallanck, Windsor, both of Conn.

[73] Assignee: The Ensign-Bickford Company, Simsbury, Conn.

[ * ] Notice: The portion of the term of this patent subsequent to Jan. 3, 2012 has been disclaimed.

[21] Appl. No.: 994,676

[22] Filed: Dec. 22, 1992

Related U.S. Application Data

[63] Continuation-in-part of Ser. No. 949,466, Sep. 22, 1992, Pat. No. 5,377,592, which is a continuation-in-part of Ser. No. 730,275, Jul. 9, 1991, Pat. No. 5,173,569.

[51] Int. Cl.[6] ..... F42C 11/06

[52] U.S. Cl. ..... 102/210; 102/206; 102/218

[58] Field of Search ..... 102/206, 210, 218, 200

[56] References Cited

U.S. PATENT DOCUMENTS

| | | | |
|---|---|---|---|
| 3,320,890 | 5/1967 | Ciccone et al. | 102/210 |
| 3,340,811 | 9/1967 | Gauld | 102/210 |
| 3,610,153 | 10/1971 | Betts et al. | 102/220 |
| 3,741,124 | 6/1973 | Visk | 102/220 |
| 3,885,501 | 5/1975 | Schneider, Jr. | 102/218 |
| 3,941,058 | 3/1976 | Gawlick et al. | 102/210 |
| 3,981,240 | 9/1976 | Gladden | 102/29 |
| 3,987,729 | 10/1976 | Andrews et al. | 102/210 |
| 3,987,732 | 10/1976 | Spraggs et al. | 102/275.5 |
| 4,311,096 | 1/1982 | Oswald | 102/220 |
| 4,328,751 | 5/1982 | Oswald | 102/220 |
| 4,393,779 | 7/1983 | Brede et al. | 102/202.5 |
| 4,395,950 | 8/1983 | Oswald | 102/200 |
| 4,445,435 | 5/1984 | Oswald | 102/215 |
| 4,481,884 | 11/1984 | Yunan | 102/313 |
| 4,586,437 | 5/1986 | Miki et al. | 102/220 |
| 4,607,573 | 8/1986 | Thureson et al. | 102/275.8 |
| 4,617,866 | 10/1986 | Simpson | 102/262 |
| 4,632,031 | 12/1986 | Jarrott et al. | 102/200 |
| 4,674,047 | 6/1987 | Tyler | 364/423 |
| 4,730,556 | 3/1988 | Cobbs, Jr. | 101/129 |
| 4,730,558 | 3/1988 | Florin et al. | 102/218 |
| 4,742,773 | 5/1988 | Bartholomew | 102/275.3 |
| 4,757,764 | 7/1988 | Thureson et al. | 102/312 |
| 4,817,530 | 4/1989 | Florin | 102/322 |
| 5,133,257 | 7/1992 | Jonsson | 102/210 |

FOREIGN PATENT DOCUMENTS

| | | |
|---|---|---|
| 67080 | 6/1990 | Australia . |
| 2206640 | 8/1972 | Germany . |
| 836415 | 8/1983 | South Africa . |
| 896536 | 8/1988 | South Africa . |
| 896936 | 9/1989 | South Africa . |
| 8000409 | 8/1988 | WIPO . |
| 8901601 | 2/1989 | WIPO . |
| 9200498 | 1/1992 | WIPO . |

*Primary Examiner*—Ian J. Lobo

*Attorney, Agent, or Firm*—Victor E. Libert; Frederick A. Spaeth

[57] ABSTRACT

An extended delay detonator (blasting cap) provides a preselected, electronically controlled delay between an incoming non-electric impulse input signal from, e.g., a shock tube or other input transmission line, and detonation of the output charge of the detonator. The delay detonator has a housing closed at one end and open at the other end for coupling to the input transmission line, the signal from which may be amplified by a booster charge mounted within the housing. A piezoelectric generator converts the optionally amplified impulse input signal to electrical output energy. A battery-powered programmable electric delay circuit is activated by the electrical output from the transducer, counts the preselected delay period, and at the end thereof ignites an electrically operable output charge. A method for interposing a preselected delay between the application of a non-electric impulse input signal and the detonation of the output charge is also provided.

18 Claims, 6 Drawing Sheets

EXTENDED RANGE DIGITAL DELAY DETONATOR

This application is a continuation-in-part of U.S. Pat. No. 5,377,592, filed on Sep. 22, 1992 which is a continuation-in-part of U.S. Pat. No. 5,173,569 filed Jul. 9, 1991.

BACKGROUND OF THE INVENTION

Field of the Invention

This invention relates to detonation devices using electronic delay timing for use with non-electric blasting initiation systems.

Background and Related Art

Blasting operations normally involve sequentially timed detonations of explosive charges placed within boreholes drilled into the earth, for example, into a rock or ore mass to be fragmented. Generally, one or more transmission lines are deployed from a central initiating point to send a signal to detonate the individual blasting charges located within the respective boreholes. These transmission lines may consist of one or more trunklines connected to a plurality of "downlines" leading from the trunklines into the boreholes to transmit the initiating signal to a detonator, sometimes referred to as a blasting cap, which, upon detonation, generates a shock wave that detonates the main explosive charge within the borehole. The timing of sequential detonations within each borehole must be closely controlled to achieve the desired fragmentation and movement of ore and rock. The time intervals between borehole detonations are on the order of milliseconds to achieve the desired results and are attained by providing a delay between the time the initiating signal is received by the detonator and the detonation of the detonator. Generally, at least an eight millisecond delay is required between adjacent boreholes, and significantly longer millisecond delays are often used.

In non-electric blasting systems the requisite delay periods may be obtained by the use of blasting caps which contain a pyrotechnic delay composition. As is well-known in the art, these delay compositions provide a length of material within the detonation train of the blasting cap which burns at a controlled rate to provide a preselected delay, e.g., 25, 50, 250 or 500 milliseconds, between the receipt of an incoming detonation signal from the downline and the detonation of the primary charge within the blasting cap to detonate the main explosive charge in the borehole. The provision of such pyrotechnic delays in blasting caps is illustrated in U.S. Pat. No. 3,987,732 to Spraggs et al, which describes a device utilizing a pair of blasting caps having different delay periods. However, such pyrotechnic delays exhibit inherent variances in burn time and hence, in the desired delay interval. Consequently, the exact delay periods associated with a given blasting cap varies within a range which depends on the manufacturing tolerances. This burn time variance, which results from compositional and manufacturing variances which, as a practical matter, are unavoidable, leads to time scatter or inaccuracy associated with the delayed ignition of the borehole charges. The variation or scatter of the ignition times can result in poor rock fragmentation and possibly damage outside the blast zone. If the time between sequential detonations is very short, for example, at or near the eight millisecond minimum, the time scatter resulting from burn time variations may approach or even exceed the programmed interval, thus resulting in out-of-sequence detonation of adjacent boreholes.

The use of electrically-initiated detonators which contain pyrotechnic delays is, of course, subject to the same problems as described above with respect to non electrically-initiated systems insofar as inherent variances of burn time of the detonator delays is concerned. The use of electrical blast sequencing machines in conjunction with instant detonators or electronically-timed detonators, while capable of providing accurate borehole-to-borehole time delays, requires an electrical potential of hundreds of volts to reliably ignite all of the large number of blasting caps used in such systems, and such voltages pose sometimes lethal safety hazards to workers in the field. On the other hand, only a relatively small amount of energy is required for the ignition of an individual electric blasting cap so that premature or unintended detonations can be caused by static electricity, ground currents, currents induced by power lines, radio-frequency or microwave sources or other sources of relatively low energy electromagnetic noise. Further, the interconnection of electric blasting caps in large blast patterns can be extremely complex and an error in calculations could result in failure of the detonation of one or more detonator caps, resulting in the very hazardous situation of undetonated main explosive charges in the muck pile caused by those charges which did explode.

Parent Patent Applications

Parent U.S. patent application Ser. No. 07/730,275, (now U.S. Pat. No. 5,173,569) describes an electrical delay detonator (blasting cap) for use in non-electric blasting systems which enables the attainment of a preselected delay in detonation of the detonator's output charge in response to the arrival of an incoming non-electric signal through the use of an electronically timed delay circuit disposed within the detonator. This parent application details the use of a transducer, e.g., a piezoelectric element which is responsive to a pressure wave generated by detonation of a booster charge which is detonated by an incoming non-electric impulse signal, e.g., from a shock tube, to power an electronic circuit providing a preset, solid state-controlled time delay for detonation of the detonator and thereby of the explosive charges served by the detonator. The disclosure of parent application Ser. No. 07/730,275, which is hereby incorporated herein, discloses a device in which the power generated by pressurizing the transducer is the source of a power needed most to initiate and operate the delay circuitry as well as activate, i.e., detonate, the booster charge. The limited amount of energy available by pressurization of the transducer necessarily limits the duration of the delay which can be attained. The device of parent application Ser. No. 07/730,275 required a booster charge to activate the transducer; in the parent case, the booster charge may be omitted if the input transmission line has sufficient energy to reliably energize the transducer, e.g., if the input transmission line is a low energy detonating cord.

Parent U.S. patent application Ser. No. 07/949,466 is a continuation-in-part of the above-described application Ser. No. 07/730,275, and describes an impulse signal delay unit for utilization in a transmission line to provide a transmission line delay. This parent application discloses the use of signal conversion means to convert an input impulse signal to electrical energy by means of a transducer such as a piezoelectric element responsive either directly to the impulse signal or to the impulse signal amplified by a booster charge. The electrical energy generated by the piezoelectric generator is conducted as a first signal to activate an electronic delay circuit to start counting a selected time interval, and as a second signal which is generated at the conclusion of the time interval to detonate an output charge. In one embodiment, the delay circuit includes a battery means which supplies power to the delay circuit upon activation thereof by the first signal so that the entire output of the piezoelectric generator can be devoted to the first and second signals and no portion thereof need be diverted to power the delay circuit. This feature permits the selection of much longer delay periods than would usually be attainable if all the energy to operate the system, including that required to power the delay circuit, had to be generated by the piezoelectric generator.

SUMMARY OF THE INVENTION

Generally, the present invention provides a delay detonator which utilizes circuitry which, like that of parent application Ser. No. 07/949,466, includes an energy source such as battery means which is used to supply power to the delay circuit upon activation by a signal received from the energized transducer. The battery means or the like is designed to provide sufficient energy to power the delay circuit even for an extended duration of delay, but the energy available from the battery means is limited so that even in the event of a short circuit or other malfunction, the energy output of the battery means is insufficient to detonate the output charge.

Specifically, in accordance with the present invention, there is provided an electrical delay detonator for use in blasting initiation systems energized by a nonelectric impulse signal. The delay detonator comprises a housing, e.g., a tubular, electrically conductive body, having one end thereof dimensioned and configured to be coupled to an input transmission line. The input transmission line may be, e.g., an input transmission tube such as a shock tube, or it may be a low energy detonating cord. In any case, the input transmission line is capable of transmitting an input non-electric impulse signal to within the housing. The housing, which may be closed at the end opposite the aforesaid one end, encloses the following components: (i) a signal conversion means disposed in signal-communicating relationship to the transmission line for receiving an impulse signal from the transmission line and converting the impulse signal to an electrical output signal; (ii) an electric circuit including delay means having an output conductor means; (iii) an electrically operable igniter element connected to the output conductor means of the electric circuit and to an output charge. The electric circuit is connected to the signal conversion means to receive from it the electrical output signal and thereupon start counting a selected time interval. Upon lapse of the time interval, the electrical output signal is transmitted by the electric circuit to the igniter element, whereby the igniter element is energized to detonate the output charge.

In one aspect of the present invention, the electric circuit includes a battery means connected thereto to supply the electric circuit with power for counting the selected time interval upon receipt by the electric circuit of the electrical output signal.

One aspect of the invention provides that the power output of the battery means is insufficient to energize the igniter element sufficiently to detonate the output charge.

In another aspect of the invention, the electric circuit comprises an oscillator for generating cycles connected to the battery means to receive power therefrom for generating the cycles, a counter connected to the oscillator for counting the cycles, and means for preloading the counter with an initial value.

Yet another aspect of the present invention provides for the inclusion of a booster charge disposed within the housing and positioned to be detonated by the impulse signal received from the input transmission line to amplify the impulse signal received by the signal conversion means.

Other aspects of the invention provide for the electric circuit to comprise means to convert the electrical output signal to a first signal which starts the counting of the time interval and a second signal which energizes the igniter element at the end of the time interval; other aspects of the invention provide for the signal conversion means to comprise (a) a transducer, e.g., a piezoelectric generator, for converting the input impulse signal to electrical energy and (b) an energy storage means, e.g., a storage capacitor, connected to the transducer to receive therefrom and store electrical energy for release from the energy storage means as the electrical output signal.

A method aspect of the present invention provides for interposing a time delay between the application of an input non-electric impulse signal received from a transmission line and the detonation of an output charge. The method comprises the following steps. (a) Converting the input impulse signal to a first electric signal. This step may be carried out by pressurizing a piezoelectric generator with the impulse input signal, The input signal may optionally be amplified by using it to detonate a booster charge which in turn pressurizes the piezoelectric generator. (b) Transmitting the first electric signal to an oscillator. (c) Counting the number of cycles generated by the oscillator in response to the first electric signal; the power to carry out this step may optionally be supplied from a battery means. (d) Generating a second electric signal upon the completion of a preprogrammed count of the number of cycles. (e) Transmitting the second electric signal to an electrically operable output charge to detonate the output charge.

These and other aspects of the present invention, together with objects and advantages thereof, will be apparent in the details of construction and operation as more fully hereinafter described and claimed, reference being had to the accompanying drawings forming a part hereof.

DETAILED DESCRIPTION OF THE INVENTION AND PREFERRED EMBODIMENTS THEREOF

The accuracy of the timing of initiation of individual explosive charges in a multiple-charge blasting system must be closely controlled to achieve the desired fragmentation of ore and rock, and to reduce the influence of the blast on structures outside the blast zone. The accuracy of timing of the initiation of individual charges controls the effectiveness of the blast by providing the required distribution of blast induced shockwaves. The present invention provides delay detonators that can be used for closely controlling the timing of the initiation of individual explosive charges in non-electric multiple-explosive charge blast operations.

Figure 1:
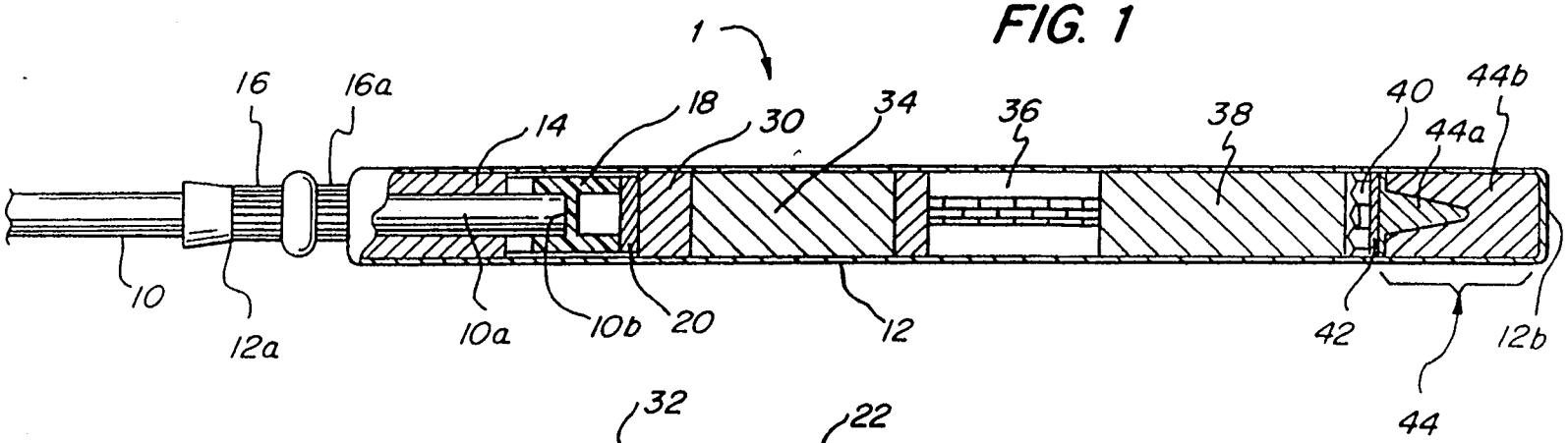
FIG. 1 is a schematic view partly in cross section showing one embodiment of the delay detonator of the present invention having a shock tube input transmission line coupled thereto.

Referring now to FIG. 1 there is shown one embodiment of an extended range digital delay detonator 1 of the present invention. In the illustrated embodiment, the delay detonator is coupled to a suitable input transmission line which comprises, in the illustrated case, a shock tube 10. It is to be understood, however, that other nonelectric signal transmission means such as a detonating cord, low energy detonating cord, low velocity shock tube and the like may be used. Generally, any suitable nonelectric, impulse signal transmission means may be employed. As is well-known to those skilled in the art, shock tube comprises hollow plastic tubing, the inside wall of which is coated with an explosive material so that, upon ignition, a low energy shock wave is propagated through the tube. See, for example, Thureson et al, U.S. Pat. No. 4,607,573. Shock tube 10 is fitted to a suitable housing 12 by means of an adapter bushing 14 about which housing 12 is crimped at crimps 16, 16a to secure shock tube 10 and form an environmentally protective seal between adapter bushing 14 and the outer surface of shock tube 10. Housing 12 has an open end 12*a* which receives bushing 14 and shock tube 10, and an opposite, closed end 12*b*. Housing 12 is made of an electrically conductive material, usually aluminum, and is preferably the size and shape of conventional blasting caps, i.e., detonators. A segment 10*a* of shock tube 10 extends within housing 12 and terminates at end 10*b* in close proximity to, or in abutting contact with, an anti-static isolation cup 18.

Figure 1A:
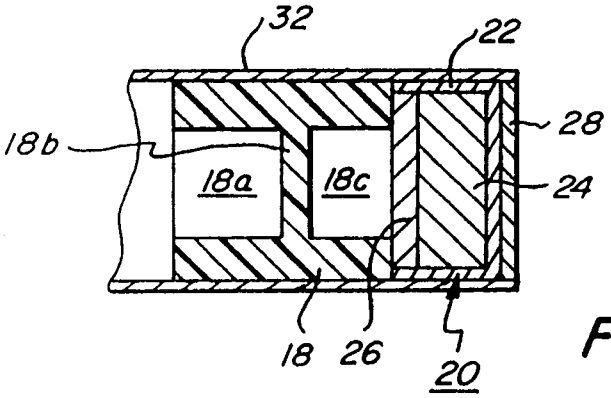
FIG. 1A is a view, on a scale which is enlarged relative to FIG. 1, of the isolation cup and booster charge components of the detonator of FIG. 1.

Isolation cup 18, as best seen in FIG. 1A, is of a type well-known in the art and is made of a semiconductive material, e.g., a carbon-filled polymeric material, so that it forms a path to ground to dissipate any static electricity which may travel along the interior of shock tube 10. For example, see Gladden U.S. Pat. No. 3,981,240. A low energy booster charge 20 is positioned adjacent to anti-static isolation cup 18. As best seen in FIG. 1A, anti-static isolation cup 18 comprises, as is well-known in the art, a generally cylindrical body (which is usually in the form of a truncated cone, with the larger diameter positioned closer to the open end 12*a* of housing 12) which is divided by a thin, rupturable membrane 18*b* into an entry chamber 18*a* and an exit chamber 18*c*. The end 10*b* of shock tube 10 (FIG. 1) is received within entry chamber 18*a* (shock tube 10 is not shown in FIG. 1A for clarity of illustration). Exit chamber 18*c* provides an air space or stand-off between the end 10*b* of shock tube 10 and booster charge 20. In operation, the shock wave traveling through shock tube 10 will rupture membrane 18*b* and traverse the stand-off provided by exit chamber 18*c* and impinge upon and detonate booster charge 20.

Booster charge 20 itself comprises a booster charge shell 22 of cup-like configuration within which is pressed a small quantity of primary explosive 24, such as lead azide, which is closed by a first cushion element 26. First cushion element 26, which is located between isolation cup 18 and primary explosive 24, protects primary explosive 24 from pressure imposed upon it during manufacture, as described in co-pending U.S. patent application Ser. No. 07/608,688, assigned to the assignee of this application.

A non-conductive buffer 28, which is typically 0.030 inches thick, is located between booster charge 20 and a piezoelectric generator 30 to electrically isolate piezoelectric generator 30 from booster charge 20.

Adapter bushing 14, isolation cup 18, first cushion element 26, and booster charge 20 may conveniently be fitted into a booster shell 32 as shown in FIG. 1A. The outer surface of isolation cup 18 is in conductive contact with the inner surface of booster shell 32 which in turn is in conductive contact with housing 12 to provide an electrical current path for any static electricity discharged from shock tube 10. Generally, booster shell 32 is inserted into housing 12 and housing 12 is crimped to retain booster shell 32 therein as well as to protect the contents of housing 12 from the environment.

Referring again to FIG. 1, a capacitor 34 is connected to piezoelectric generator 30 to receive electrical output from generator 30 for storage. Capacitor 34 may be a 10 micro-farad unit rated at 35 volts. Its series resistance is preferably low to accommodate the fast rise-time of the 1 to 2 microsecond-long pulses it will receive from piezoelectric generator 30.

A battery means 36 is positioned next to capacitor 34 and adjacent to battery means 36 is a timing module 38 next to which is located an electrically activated igniter means 40. A second cushion element 42, which is similar to first cushion element 26, is interposed between output charge 44 and an electrically activated igniter means 40 for the same purpose as first cushion element 26. Output charge 44 comprises a primary explosive 44*a* and a secondary explosive 44*b*, which has sufficient shock power to detonate cast booster explosives, dynamite, etc., the detonation of which is the usual purpose to which detonators are put. Igniter means 40, which is connected to the output of timing module 38, when energized, detonates primary explosive 44*a*, which in turn detonates secondary explosive 44*b*, i.e., igniter means 40 serves to detonate output charge 44. Igniter means 40 is positioned within a preferably non-conductive bushing (not shown) which serves to prevent inadvertent detonation of output charge 44 by igniter means 40 by virtue of the relatively low resistivity of the bushing and its contact with housing 12.

The components contained within housing 12 are suitably encased within potting compounds to protect the components, and minimize the chances of detonation or damage by mechanical impact or electrical signals. The fact that housing 12 is made of aluminum or other electrically conductive material, also helps to shield the internal components against both electrical signals and mechanical shocks that could inadvertently activate booster charge 20 or output charge 44. The electrically conductive housing 12 provides a high degree of attenuation of potentially damaging electrical fields by forming a Faraday cage around the electrically sensitive components. The size and configuration of the housing 12 is, as noted above, preferably selected to duplicate industry standard detonator sizes currently in use.

In operation, the digital delay detonator 1 of FIG. 1 receives a pressure input pulse via shock tube 10 which detonates booster charge 20, the explosive output of which is thus an amplification of the pressure input pulse delivered by shock tube 10. Piezoelectric generator 30 is subjected to the energy delivered by the explosion of booster charge 20 and converts the energy into electrical energy. This electrical energy is stored in storage capacitor 34 and a part of it is used to activate the timing circuit of timing module 38 and, after lapse of a preselected interval, to energize igniter means 40 to detonate output charge 44. Battery means 36 is used to supply the necessary power to operate the delay timing circuitry of timing module 38. Upon completion of its timing cycle, the stored energy from capacitor 34 is applied to electrically activated igniter means 40, thereby detonating primary explosive 44*a* and secondary explosive 44*b*. The delay detonator 1 may thus be employed to provide a very accurately controlled delay in the initiation of an explosive charge as may be required in blasting patterns in which a large number of charges are to be detonated in a predetermined timing pattern. The electronic circuit control of the delay permits much more accurate delays than those which are attainable by conventional pyrotechnic delays, and the battery-powered timing means permits the selection of much longer delays than would be attainable if the piezoelectric generator 30 had to supply the power for both powering the timing circuits and energizing the igniter means 40.

Figure 2:
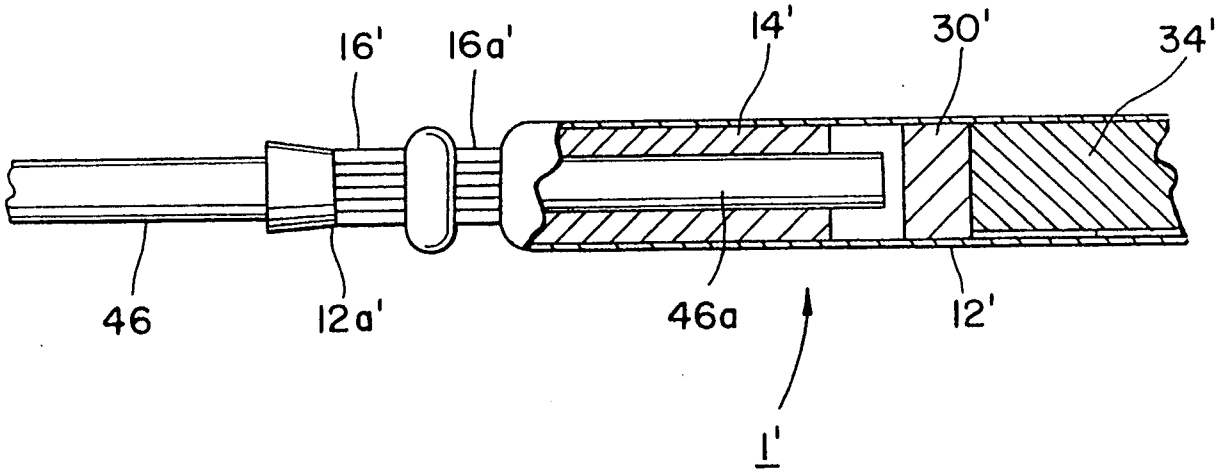
FIG. 2 is a partial schematic view partly in cross section showing a second embodiment of the delay detonator of the present invention having a low energy detonating cord input transmission line coupled thereto.

Referring now to FIG. 2, in which parts identical to those of the FIG. 1 embodiment are identically numbered except for the addition of a prime indicator, an alternative embodiment of the present invention comprises a detonator 1', only a portion of which is shown in FIG. 2. In this embodiment, shock tube 10 of the FIG. 1 embodiment is replaced by a transmission line comprising a low energy detonating cord 46 which is mounted within adapter bushing 14' located at open end 12*a'* of housing 12' so that a portion 46*a* thereof is sealed within housing 12' by crimps 16', 16*a'* cooperating with bushing 14' and detonating cord 46. The energy output of detonating cord 46 is selected to be low enough not to destroy components of delay detonator 1' so as to prevent it from functioning, but high enough to cause the input impulse signal provided by the explosive output of low energy detonating cord 46 to act, without need for amplification, directly on piezoelectric generator 30'. Generator 30' responds to the shock wave from low energy detonating cord 46 to generate electrical energy that is transmitted for storage in storage capacitor 34'. Consequently, booster charge 20 of the FIG. 1 embodiment is omitted from the embodiment of FIG. 2, as is isolation cup 18, for which there is no need in the embodiment of FIG. 2. Otherwise, the other parts of the FIG. 2 embodiment, their arrangement and operation are the same as those discussed in conjunction with the embodiment of FIG. 1 and it is therefore not necessary to repeat the illustration and description thereof. Generally, in the FIG. 2 embodiment, the energy necessary to energize piezoelectric generator 30' is derived directly from the shock wave coming from low energy detonating cord input 46.

Figure 3:
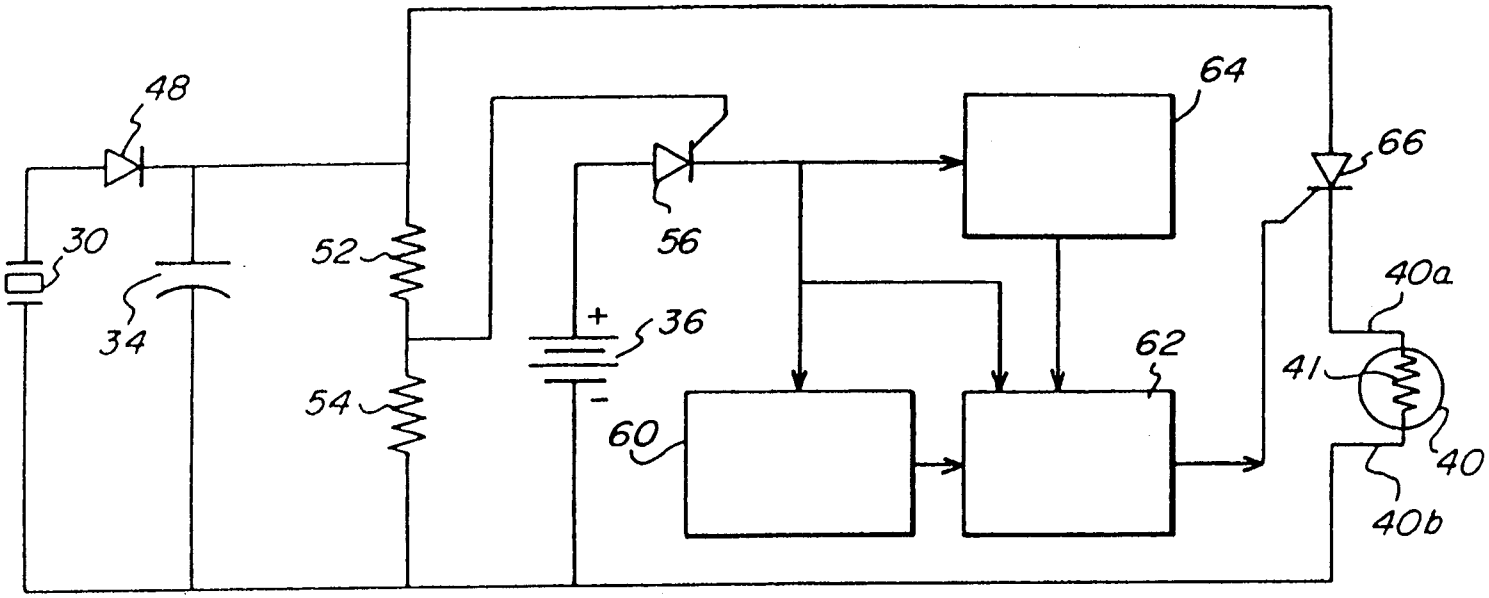
FIG. 3 is a schematic block diagram depicting the major components of the ignition and electronic delay circuitry of the present invention.

FIG. 3 details schematically an example of an electronic timing circuit suitable for use in timing module 38. Elements of FIG. 3 which are also illustrated in FIG. 1 are identically numbered in both Figures. Piezoelectric generator 30 generates electrical current when it is pressurized as described above, e.g., by detonation of booster charge 20 (FIG. 1) or low energy detonating cord 46 (FIG. 2). The output energy from generator 30 passes through steering diode 48 and is stored in storage capacitor 34. The voltage reached by capacitor 34 is divided by resistors 52 and 54 to activate silicon controlled rectifier ("SCR") 56. Once activated, SCR 56 causes the power from battery means 36 to be applied to the timing circuits comprising oscillator 60, programmable counter 62, and power-on reset ("POR") circuit 64. At the conclusion of the preset timing interval, SCR 66 is activated by programmable counter 62 thereby releasing the electrical energy stored in capacitor 34 to flow to igniter means 40.

During operation of the timing circuit of FIG. 3, the POR circuit 64 preloads the programmable counter 62 with count information, setting the counter 62 with an initial preset count value. This preloading occurs upon the activation of SCR 56, i.e., at the time capacitor 34 receives the electrical input from piezoelectric generator 30. Concurrently, oscillator 60 starts generating pulses (or cycles) that are counted by counter 62. As the counter 62, activated by the pulses from oscillator 60, reaches a preselected count, as for example 1, the preprogrammed delay period expires and an activation signal is sent to SCR 66. The activation signal puts SCR 66 in a conducting state which allows SCR 66 to conduct the electrical energy in capacitor 34 to igniter means 40 via lead 40*a*, bridge wire 41, and lead 40*b*, thereby detonating output charge 44. (Output charge 44 is not shown in FIG. 3 but is shown in FIG. 1.)

The arrival of the energy from storage capacitor 34 at igniter means 40 and the consequent detonation of output charge 44 is therefore delayed by an interval essentially equal to the time required for the programmable counter 62 to count the pulses from oscillator 60 from the initial preset amount established by POR circuit 64 to some value, such as, for example, 1. This arrangement provides an accurate time delay means for a non-electric, pressure-type signal, i.e., an impulse input signal provided to the delay detonator of the present invention by a suitable transmission line such as shock tube 10 (FIG. 1) or detonating cord 46 (FIG. 2). The programmed delay will have an exceedingly small unitto-unit variance. Consequently, the variance in time delay detonation of each borehole in a group of multiple boreholes will correspondingly be exceedingly small. The programmability of the circuitry allows a single type or model of delay detonator in accordance with the present invention to be used for the implementation of different delays. Thus, a single stock item may be used to provide an entire series of highly accurate detonators of selected delay periods.

Figure 4:
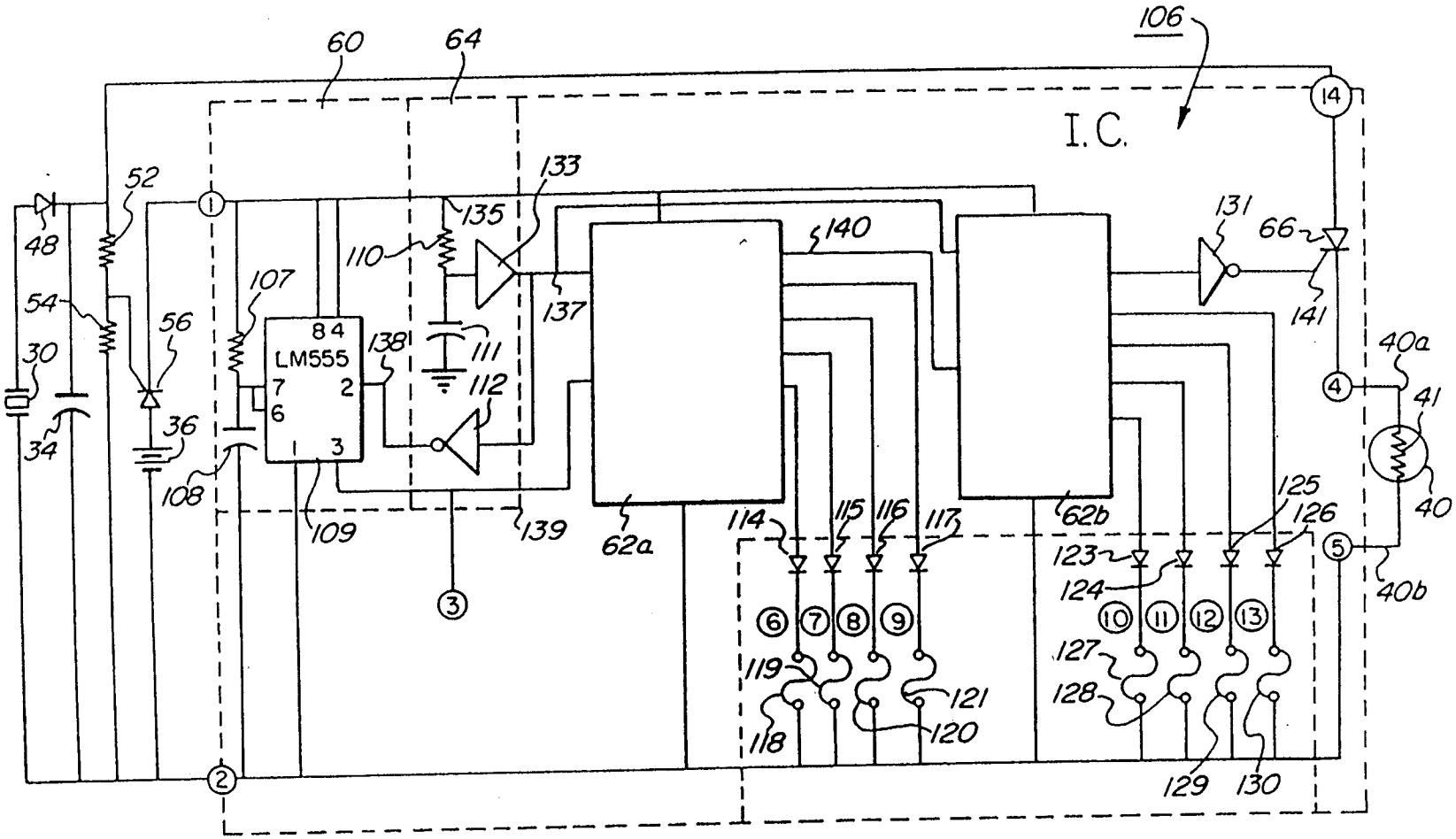
FIG. 4 is a schematic block diagram depicting the electronic counting and programming circuitry of a typical embodiment of the present invention.

FIG. 4 is a more detailed version of the circuitry of FIG. 3, in which some details of typical circuitry suitable for oscillator 60, programmable counter 62 and POR circuit 64 are shown. Elements of FIG. 4 which are illustrated in FIG. 3 are identically numbered in both Figures.

As described above in connection with FIG. 3, upon activation of the piezoelectric generator 30, current flows through the steering diode 48 to charge the storage capacitor 34 and the voltage divider formed by resistor 52 and resistor 54 provides a trigger signal to SCR 56, which causes the power from battery means 36 to be applied to the timing circuitry. Referring to FIG. 4, programmable counter 62 is seen to comprise a first counter 62*a*, and a second counter 62*b*, both of which typically may be wellknown monolithic counters such as an industry standard part number 40193. FIG. 4 shows standard nomenclature to indicate various parts and connectors, viz., VDD=power and VSS=ground. The POR circuit 64 includes resistor 110, capacitor 111, Schmidtt-Trigger buffer 133, and inverter 112. Alternatively, an oscillator circuit could be made up of a crystal oscillator, as is well-known in the art. In any case, upon application of input voltage to it, POR circuit 64 preloads first counter 62*a*. Once the voltage from the battery means 36 has increased beyond a threshold setting, first counter 62*a* begins decrementing with each input pulse from the oscillator 60. As the counter decrements past zero, the output to SCR 66 is activated and the energy in storage capacitor 34 is applied to the igniter means 40.

There are many known methods of accomplishing the delay aspect of the operation and FIG. 4 shows one exemplary circuit which will accomplish the timing task. The circuit of FIG. 4 may be comprised of commercially available components and the specific embodiment of the invention illustrated incorporates items such as counters 62*a* and 62*b*, and the components numbered 107 through 133 onto a single complementary metal oxide semiconductor integrated circuit ("I.C.") 106.

The circuit of oscillator 60 is comprised of timing resistor 107, timing capacitor 108, and a commercially available LM 555 timer 109. The programming circuitry utilizes steering diodes 114–117, and 123–126, as well as fuses 118–121 and 127–130.

Once SCR 56 is triggered on as described above, power is applied to the delay circuitry from battery means 36. Capacitor 111 of POR circuit 64 is slowly charged through resistor 110 by the voltage apparent at node 135. Once the voltage at capacitor 111 has attained a level of two-thirds of the voltage of node 135, buffer 133 switches the signal of node 137 from a low to a high state. While node 137 is held low, the preset inputs to the counters are active, causing the signals apparent at the respective sets of inputs P1 to P4 to be loaded into the counters 62*a* and 62*b*. At this point, the inhibit signal node 138 is held high to prevent the oscillator 60 from functioning. Once node 137 switches from low to high, both the oscillator 60 and counters 62*a*, 62*b* are enabled and begin functioning.

The output of the oscillator 60 at node 139 directly decrements counter 62*a* from its preset value. As counter 62*a* decrements past zero, node 140 is pulsed low and triggers second counter 62*b* to decrement one count. Operation continues in this manner until counter 62*b* decrements past zero. At this time, the borrow output from counter 62*b* is switched low, gets inverted to a high by inverter 131 at node 141, and activates SCR 66, causing the energy in storage capacitor 34 to be applied to igniter means 40 as described above.

Programming of the circuit illustrated in FIG. 4 is accomplished by applying a voltage to pins 6 to 13. This voltage application produces a current flow through fuses 118–121 and 127–130. Pin 3 connected to node 139 is provided to allow measurement of the actual oscillator frequency. Through the use of this measurement, it is possible to program extremely precise delay intervals without the complications of precision trimming the oscillator 60 to a specific frequency.

Generally, fuses 118–121 program first counter 62*a* to divide by an integer up to 16, as is well-known in the art. Similarly, fuses 127–130 program second counter 62*b*. In this configuration, first counter 62*a* will output a signal after a number of cycles have been received from the LM 555 timer 109 of oscillator 60, i.e., a signal will be output when the counter has counted down by the number of preprogrammed cycles or pulses received from oscillator 60. Second counter 62*b* receives its input from the output of first counter 62*a*. The input to second counter 62*b* will be essentially divided as programmed by fuses 118–121. The state of these fuses determines the counting program of counters 62*a* and 62*b*, as is well-known in the art.

During counter operation, the output pulses from oscillator 60 will be divided by both first counter 62*a* and second counter 62*b* as programmed by fuses 118–121 and 127–130. For example, if first counter 62*a* is programmed to count down (or divide) from 6, and second counter 62*b* is programmed to count down from 8, then SCR 66 will be activated after 48 pulses have been generated by oscillator 60 and counted down by both counters.

While a two-stage counter circuit (counter 62*a* and 62*b*) is shown in FIG. 4, additional stages may be cascaded as is well-known in the art for longer time delays or improved programming resolution.

Figure 5:
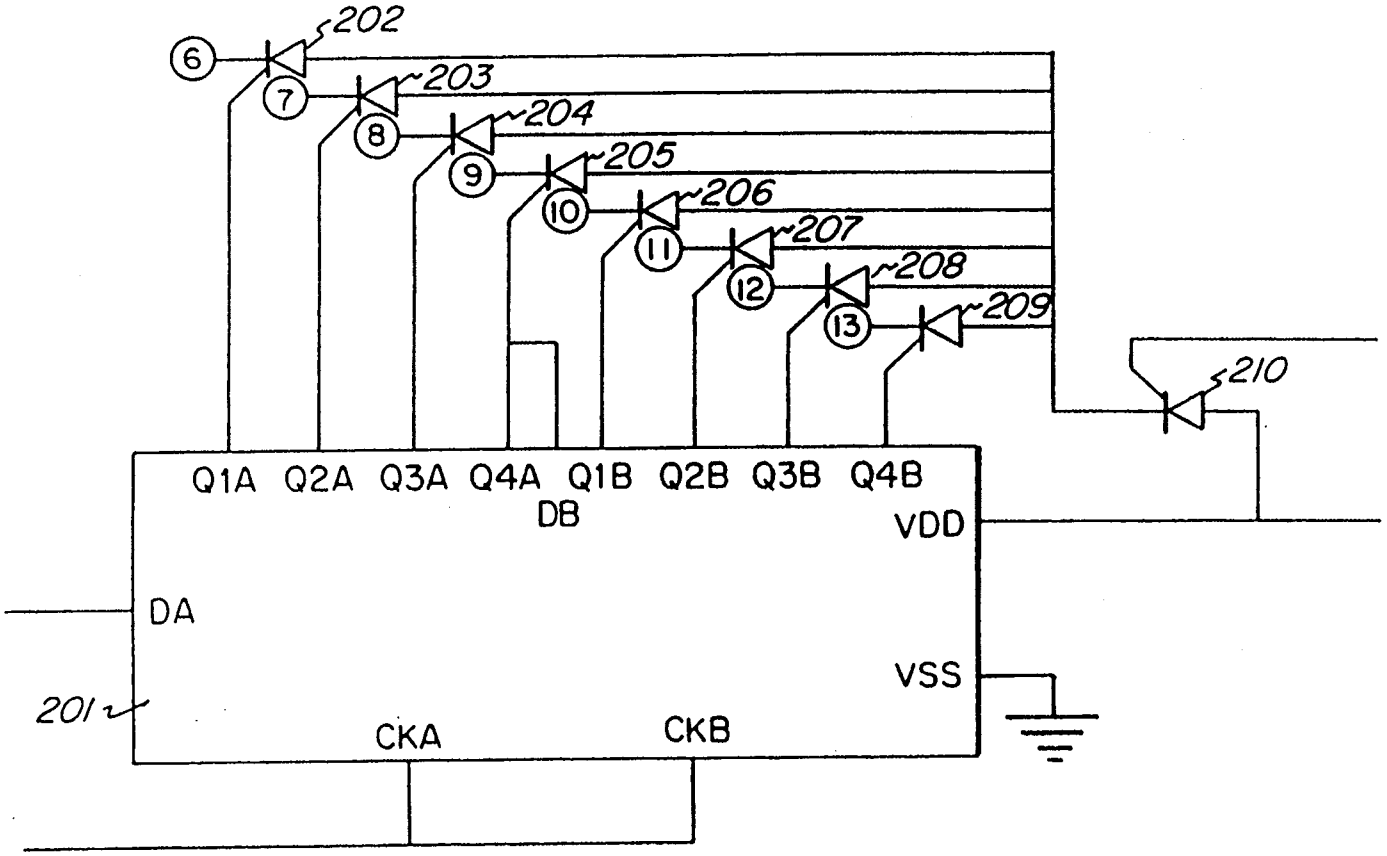
FIG. 5 is a schematic block diagram depicting additional programming circuitry usable in conjunction with the circuitry of FIG. 4.

The programming section of FIG. 4 is simple in that parallel connections are used and the fuses are all burned at the same time. While this produces no difficulties for factory programming of the units, the number of external connections required makes programming in the field prohibitive. If field programmability of the delay detonator is desired, additional programming circuitry may be utilized to reduce the number of external connections to a point where programming in a field environment is feasible. An example of such additional circuitry is schematically illustrated in FIG. 5, wherein a dual, four-stage static shift register, standard part number 4015, is illustrated and standard nomenclature is shown to indicate various parts and connectors, viz., VDD=power, VSS=ground, CKA and CKB=clocks for segments A and B respectively, DA and DB=data for segments A and B respectively, and Q1A–Q4A and Q1B–Q4B=data outputs for segments A and B respectively. The illustrated SCRs 202 through 209 are used to select the appropriate fuses (shown in FIG. 4) for programming. Activation of these SCRs is performed by loading the required data lines serially into shift register 201. A commercially available 4015 shift register is shown schematically in FIG. 5 but a preferred embodiment would include these functions on the I.C. 85 of FIG. 4. Once the required programming SCRs are active, a high signal is applied to SCR 210. This high signal applies the programming voltage through the selected SCRs (202–209) and burns out the associated fuse illustrated in FIG. 4. By utilizing the circuit of FIG. 5, the required number of pins for programming is made independent of the number of stages used for the counter.

Figure 6:
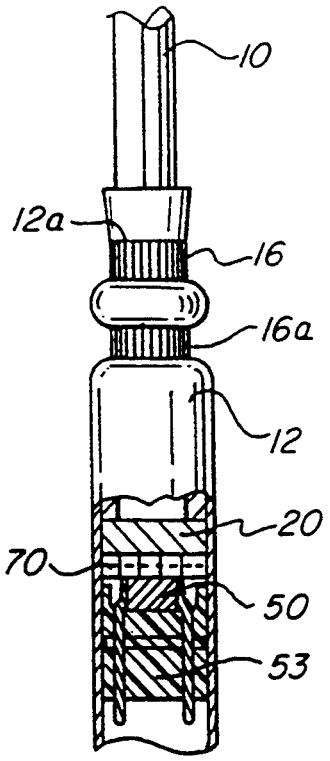
FIG. 6 is a schematic partial view generally corresponding to that of FIG. 1 but showing a schematic structural rendition of piezoelectric generator 30 instead of the schematic box rendition of FIG. 1.
Figure 7:
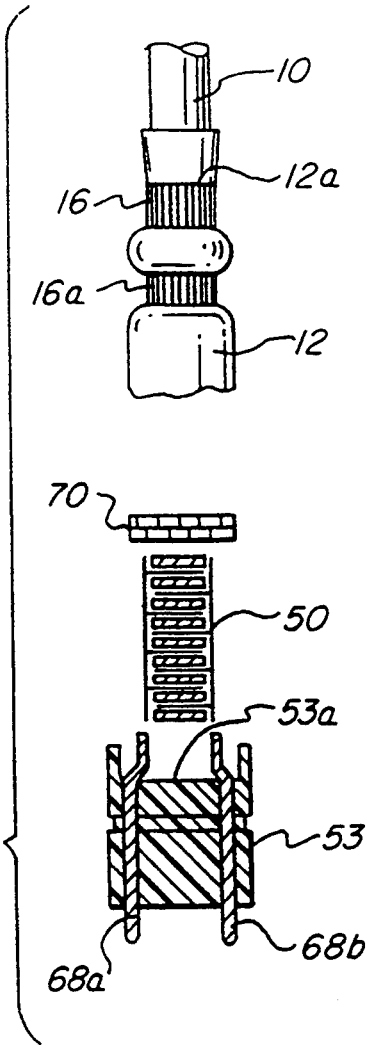
FIG. 7 is a schematic exploded view of the components of FIG. 6 on a scale enlarged relative to FIG. 6, with the piezoelectric generator component thereof shown in a more detailed, schematic rendition.
Figure 8:
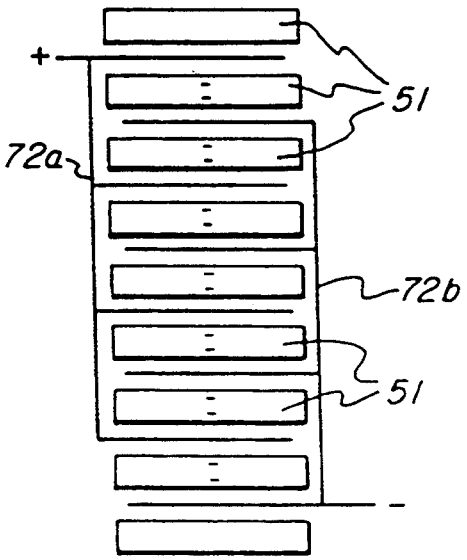
FIG. 8 is a view on a scale enlarged with respect to FIG. 7 of a more detailed schematic view of the piezoelectric generator of FIGS. 6 and 7.

While any suitable transducer may be employed in the practice of the present invention, an effective type of piezoelectric generator is schematically illustrated in FIGS. 6, 7 and 8, in which elements which are also shown in FIGS. 1 and 1A are numbered identically in both sets of Figures.

The piezoelectric generator 30 comprises a piezoceramic material stack 50 comprised of a stack of multiple layers 51 of thin piezoceramic material. The stack 50 is supported on a suitable plastic (synthetic organic polymeric material) housing 53, through which terminals 68A and 68b (FIG. 7) extend. The output energy from the booster charge 20 impinges substantially directly upon a load distributing disc 70 (not shown in FIGS. 1 or 1A), which in turn evenly transmits the energy from the booster charge 20 to the multiple layers 51 of suitable thin piezoceramic material which comprise one embodiment of the stack 50 of piezoelectric generator 30. As best seen in the schematic representation of FIG. 8, the piezoceramic material layers 51 are stacked in vertical layers with opposite faces of each layer connected in parallel through the use of electrode layers **72*a* and 72*b* interposed between each layer or element 51. In one embodiment, the piezoelectric generator of the present invention uses 84 active layers, each approximately 20 microns thick, with discrete positive and negative electrodes as marked on FIG. 8** formed from the inner connections. This construction provides output energy levels much greater than those which can be obtained from an otherwise comparable monolithic piezoceramic structure.

Referring to FIGS. 6, 7 and 8 jointly, the plastic housing 53 and load distributing disc 70 contribute, in a preferred structure of the present invention, to obtaining the maximum benefit from the output shock wave of the booster charge 20 and the physical pressure attendant thereto. The stack 50 of piezoelectric generator 30 is mounted to a smooth, flat and hard surface **53*a* of plastic housing 53 (FIG. 7). Surface 53*a* is substantially parallel to the shock wave front generated by detonation of booster charge 20 and perpendicular to the direction of shock wave travel. To further obtain maximum benefit from the output shock wave of the booster charge 20, the load distributing disc 70 is disposed substantially parallel to and between the output end of the booster charge 20 and the input face of the piezoelectric generator 30 to evenly transmit and distribute the output shock wave energy of the booster charge 20 to the piezoelectric generator 30. This arrangement also helps to prevent premature shattering of the piezoelectric generator 30 which would render it inoperable. Terminals 68*a* and 68*b* are electrically connected to electrode layers 72*a* and 72*b* to establish the desired electrical connection to the timing module 38. Plastic housing 53 and load distributing disc 70 also serve to insulate piezoelectric generator 30** against unintended and random mechanical forces, any electrical charges, etc., and serves to help maintain the piezoelectric generator in the desired position.

Although the present invention has been shown and described with respect to preferred embodiments, various changes and other modifications which are obvious to persons skilled in the art to which the invention pertains are deemed to lie within the spirit and scope of the invention. For example, the input pressure signal need not be limited to shock tubes but can be derived from other non-electric, pressure transmission devices such as low energy detonating cord, or low velocity shock tube, or any other source of shock energy that can be made to reach the piezoelectric generator to produce the input pressure needed to output the required electrical signal. Furthermore, the timing circuit described can also comprise other ways of timing an interval as is well-known in the art.

What is claimed is:

1. An electrical delay detonator for use in blasting initiation systems energized by a nonelectric impulse signal comprises a housing means having one end thereof dimensioned and configured to be coupled to an input transmission line capable of transmitting a nonelectric impulse input signal to within the housing, the housing enclosing: (i) a signal conversion means disposed in signal-communicating relationship to the transmission line for receiving an impulse signal from the transmission line and converting the impulse signal to an electrical output signal; (ii) an electric circuit including delay means for counting a selected time interval in response to receiving the electrical output signal, a battery means to supply the electric circuit with power for counting the selected time interval independently of the output signal, and an output conductor means, the electric circuit being connected to the signal conversion means to receive therefrom the electrical output signal and thereupon to start counting a selected time interval and, upon lapse of the time interval, to transmit the electrical output signal to the output conductor means; (iii) an electrically operable igniter means connected to the output conductor means of the electric circuit and to an output charge; the igniter means being energized to detonate the output charge upon receipt of the electrical output signal from the electric circuit, the electric circuit being connected to the signal conversion means to receive therefrom the electrical output signal and thereupon start counting a selected time interval and, upon lapse of the time interval, to transmit the electrical output signal to the igniter element, whereby the igniter element is energized to detonate the output charge.

2. The delay detonator of claim 1 wherein the power output of the battery means is insufficient to energize the igniter means sufficiently to detonate the output charge.

3. The delay detonator of claim 1 wherein the electric circuit comprises an oscillator for generating cycles connected to the battery means to receive power therefrom for generating cycles, a counter connected to the oscillator for counting the cycles, and means for preloading the counter with an initial value.

4. The delay detonator of claim 1 wherein the signal conversion means comprises (a) a transducer for converting the impulse input signal to electrical energy and (b) an energy storage means connected to the transducer to receive therefrom and store electrical energy for release from the energy storage means as the electrical output signal and the electric circuit comprises (c) an oscillator for generating cycles connected to the battery means to receive power therefrom for counting the cycles, (d) a counter connected to the oscillator, and (e) means for preloading the counter with an initial value.

5. The delay detonator of claim 1 wherein the housing comprises a tubular, electrically conductive body closed at the end thereof opposite said one end.

6. The delay detonator 1 including a booster charge disposed within the housing and positioned to be detonated by the impulse input signal received from the input transmission line to amplify the impulse input signal received by the signal conversion means.

7. The delay detonator of claim 1 wherein the electric circuit comprises means to convert the electrical output signal to a first signal which starts the counting of the time interval and a second signal which energizes the igniter means at the end of the time interval.

8. The delay detonator of claim 1 wherein the signal conversion means comprises (a) a transducer for converting the impulse input signal to electrical energy and (b) an energy storage means connected to the transducer to receive therefrom and store electrical energy for release from the energy storage means as the electrical output signal.

9. The delay detonator of claim 8 including a booster charge disposed within the housing and positioned to be detonated by the impulse input signal received from the input transmission line to amplify the impulse input signal received by the signal conversion means.

10. The delay detonator of claim 8 wherein the transducer comprises a piezoelectric generator.

11. The delay detonator of claim 10 wherein the energy storage means comprises a storage capacitor.

12. The delay detonator of claim 8 including an input transmission line coupled thereto.

13. The delay detonator of claim 12 wherein the input transmission line comprises an input transmission tube.

14. The delay detonator of claim 13 wherein the input transmission tube comprises a shock tube.

15. The delay detonator of claim 12 wherein the input transmission line comprises a low energy detonating cord.

16. A method for interposing a time delay between the application of an impulse input nonelectric signal received from a transmission line and the detonation of an output charge, comprising the steps of:

(a) converting the impulse input signal to a first electric signal;

(b) transmitting the first electric signal to oscillator;

(c) counting the number of cycles generated by the oscillator in response to the first electric signal;

(d) generating a second electric signal upon the completion of a preprogrammed count of the number of cycles;

(e) transmitting the second electric signal to an electrically operable output charge to detonate the output charge; and (f) supplying power to carry out the counting of step (c) from a battery means independently of the first electric signal.

17. The method of claim 16 including carrying out step (a) by pressurizing a piezoelectric generator with the impulse input signal.

18. The method of claim 17 including amplifying the impulse input signal transmitted to the piezoelectric generator by using it to detonate a booster charge which pressurizes the piezoelectric generator.

* * * * *